United States Patent [19]

Tiegs et al.

[11] Patent Number: 5,015,290

[45] Date of Patent: May 14, 1991

[54] DUCTILE $NI_3AL$ ALLOYS AS BONDING AGENTS FOR CERAMIC MATERIALS IN CUTTING TOOLS

[75] Inventors: Terry N. Tiegs, Lenoir City, Tenn.; Robert R. McDonald, Traverse City, Mich.

[73] Assignee: The Dow Chemical Company, Midland, Mich.

[21] Appl. No.: 420,975

[22] Filed: Oct. 12, 1989

Related U.S. Application Data

[62] Division of Ser. No. 146,992, Jan. 22, 1988, Pat. No. 4,919,718.

[51] Int. Cl.[5] ..... C22C 29/12

[52] U.S. Cl. ..... 75/232; 51/307; 51/309; 175/409; 75/236; 75/240; 75/244; 419/13; 419/17; 419/18; 419/19; 419/32; 419/33; 419/48

[58] Field of Search ..... 75/232, 236, 240, 244; 419/13, 17, 18, 19, 32, 33, 48; 51/307, 309; 175/409

[56] References Cited

U.S. PATENT DOCUMENTS

| | | | |
|---|---|---|---|
| 2,823,988 | 2/1958 | Grant et al. | 75/0.5 |
| 2,884,688 | 5/1959 | Herz | 29/182 |
| 2,957,232 | 10/1960 | Bartlett | 29/192 |
| 2,974,039 | 3/1961 | Deventer et al. | 75/201 |
| 3,000,734 | 9/1961 | Grant et al. | 75/201 |
| 3,520,675 | 8/1970 | Miller | 75/0.5 |
| 3,524,744 | 8/1970 | Parikh | 75/171 |
| 3,591,362 | 8/1971 | Benjamin | 75/0.5 BA |
| 3,623,849 | 8/1969 | Benjamin | 29/182.8 |
| 3,660,049 | 5/1972 | Benjamin | 29/182.5 |
| 3,676,161 | 7/1972 | Yates | 106/55 |
| 3,723,092 | 3/1973 | Benjamin | 75/0.5 R |
| 3,728,088 | 4/1973 | Benjamin | 29/182.5 |
| 3,778,249 | 12/1973 | Benjamin et al. | 75/0.5 BC |
| 3,785,801 | 1/1974 | Benjamin | 75/0.5 BC |
| 3,809,545 | 5/1974 | Benjamin | 75/0.5 R |
| 3,809,546 | 5/1974 | Prasse et al. | 75/0.5 BC |
| 3,914,507 | 10/1975 | Fustukian | 428/404 |
| 3,916,497 | 11/1975 | Doi et al. | 29/182.8 |
| 3,954,419 | 5/1976 | Kaufman et al. | 29/182.5 |
| 4,019,874 | 9/1977 | Moskowitz | 419/13 |
| 4,108,649 | 8/1978 | Moskowitz | 419/32 |
| 4,140,528 | 2/1979 | Hebeison et al. | 75/246 |
| 4,226,644 | 10/1980 | Cox et al. | 148/2 |
| 4,275,124 | 6/1981 | McComas et al. | 428/564 |
| 4,342,595 | 8/1982 | Bourdeau | 75/238 |
| 4,362,696 | 12/1982 | Brehm, Jr. et al. | 376/417 |
| 4,377,553 | 3/1983 | Korenko | 420/584 |
| 4,461,741 | 8/1984 | Okazaki | 420/460 |
| 4,466,829 | 8/1984 | Nishigaki et al. | 75/240 |
| 4,478,791 | 10/1984 | Huang et al. | 420/590 |
| 4,494,987 | 1/1985 | Korenko | 75/124 |
| 4,497,660 | 2/1985 | Lindholm | 75/240 |
| 4,557,893 | 12/1985 | Jatkar et al. | 419/12 |
| 4,572,738 | 2/1986 | Korenko et al. | 75/128 Z |
| 4,596,354 | 6/1986 | Moorhead | 228/122 |
| 4,606,888 | 8/1986 | Huang et al. | 420/459 |
| 4,609,528 | 9/1986 | Chang et al. | 419/62 |
| 4,612,165 | 9/1986 | Liu et al. | 420/459 |
| 4,613,368 | 9/1986 | Chang et al. | 75/246 |
| 4,613,480 | 9/1986 | Chang et al. | 419/30 |
| 4,711,761 | 12/1987 | Liu et al. | 420/459 |
| 4,722,828 | 2/1988 | Liu | 420/455 |
| 4,731,221 | 3/1988 | Liu | 420/445 |
| 4,774,052 | 9/1988 | Nagle et al. | 420/590 |
| 4,807,402 | 2/1989 | Rai | 51/309 |
| 4,839,140 | 6/1989 | Cathcart et al. | 420/445 |
| 4,919,718 | 4/1990 | Tiegs et al. | 75/232 |
| 4,946,643 | 8/1990 | Dunmead et al. | 419/17 |

FOREIGN PATENT DOCUMENTS

| | | | |
|---|---|---|---|
| 910087 | 9/1972 | Canada | 75/1 |
| 931982 | 8/1973 | Canada | 261/24 |

OTHER PUBLICATIONS

Brookes, K. J. A., in *Cemented Carbides for Engineers and Tool Users*, pp. 9–11 and 41–43 (1963).

*Primary Examiner*—Stephen J. Lechert, Jr.

[57] ABSTRACT

An improved ceramic-metal composite comprising a mixture of a ceramic material with a ductile intermetallic alloy, preferably $Ni_3Al$.

3 Claims, 2 Drawing Sheets

DUCTILE $Ni_3AL$ ALLOYS AS BONDING AGENTS FOR CERAMIC MATERIALS IN CUTTING TOOLS

STATEMENT OF GOVERNMENT INTEREST

The U.S. Government has a paid-up license in this invention and the right in limited circumstances to require the patent owner to license others on reasonable terms as provided for by the terms of contract No. DE-AC05-840R21400 awarded by the Department of Energy.

CROSS-REFERENCE TO RELATED APPLICATION

This is a divisional of U.S. application Ser. No. 146,992, filed Jan. 22, 1988, U.S. Pat. No. 4,919,718.

BACKGROUND OF THE INVENTION

The present invention relates to mixtures of ceramic and metal materials.

Sintered refractory oxides and carbides have many desirable properties such as corrosion resistance, wear resistance, and mechanical strength at elevated temperatures. These materials, however, lack the thermal and mechanical shock resistance of many metals. Much research has been directed toward combining the good wear qualities of ceramic materials (i.e., refractory oxides and carbides) with the good thermal and mechanical shock characteristics of metals. Thus, the combination of a ceramic material with a metal to form a composite structure has been referred to in such terms as cermet, ceramet, ceramal, and metamic. Specific examples of these composites include the bound hard metal carbides or cemented carbides, such as, composites of tungsten carbide and cobalt. Much of the modern, high-speed machining of metals has been made possible by use of these materials. Ceramic-metal composites also find use in many other applications such as rock and coal drilling equipment, dies, wear surfaces, and other applications where wear and corrosion resistance are important.

The historical development of cemented carbide materials is described by Schwarzkopt, P. et al. in *Cemented Carbides,* pp. 1–13, The Macmillan Co., N.Y. (1960). As indicated, many of the carbide compositions developed, including mixed carbide systems, utilized cobalt as the binder material. These composites, including tungsten carbide bonded with cobalt, are presently widely used because of their hardness, strength, and toughness at elevated temperatures. Unfortunately, the use of ceramic materials, such as tungsten carbide, is limited by the elevated temperature strength of the cobalt binder material. Further, cobalt is a strategic material for which it is desirable to find a substitute. Materials prepared using $Ni_3Al$ will be less expensive than materials prepared using cobalt.

U.S. Pat. No. 3,551,991 discloses preparing cemented carbides by sintering a pressed mixture of a refractory metal carbide and an iron group (Fe, Co, Ni) binder, then removing the binder, such as by exposure to boiling 20 percent HCl for seven days in the case of removing cobalt from WC/Co. The remaining skeletal structure is freed of residual acid, and is then infiltrated with a second binder, such as copper, silver, gold or alloys of nickel or cobalt with various metals, such as aluminum, niobium, tantalum, chromium, molybdenum or tungsten.

Viswanadham, R. K. et al., in *Science of Hard Materials,* Plenum Press, N.Y., pp. 873–889 (1983) disclose the preparation of certain WC-(Ni, Al) cermets. At page 882 it is disclosed that WC/Co composites generally are harder than composites of WC/(Ni, Al).

SUMMARY OF THE INVENTION

It is therefore an object of this invention to provide an improved ceramic-metal composite.

Another object of this invention is to provide an alloy for bonding ceramic materials to form composites without needing acid leaching.

Another object of this invention is to provide a ceramic-metal composite having improved hardness.

Yet another object of this invention is to provide a metal alloy binder for a ceramic material which permits tailoring of the hardness and toughness properties of the composite.

The invention includes an improved composite metallurgical composition comprising from about 80 to about 95 weight percent of a ceramic material and from about 5 to about 20 weight percent of a ductile alloy comprising an alloy selected from the group consisting of $Ni_3Al$, $TiSi_2$, NiSi, $MoSi_2$ and alloys thereof.

DETAILED DESCRIPTION OF THE INVENTION

The invention is a composite comprising a ceramic material and a ductile metal alloy.

The ductile metal alloy comprises an alloy of $Ni_3Al$, $TiSi_2$, NiSi, or $MoSi_2$ as well as mixtures thereof. For the purposes of the present invention the term "ductile" means that the subject alloy will elongate by at least about 10 percent of its original length when strained under load. Preferred ductile alloys will elongate by at least 25 percent, and more preferably by at least 40 percent. Alloys of $Ni_3Al$ are preferred, and examples of these include alloys disclosed in U.S. Pat. No. 4,612,165: U.S. Pat. No. 4,722,828: and U.S. Pat. No. 4,711,761; the teachings of which are incorporated herein by reference: as well as the ductile alloys disclosed in GB 2,037,322, which discloses $Ni_3Al$—based intermetallic compounds containing Ca, Mg, Y, Ti, Si, Hf, rare earth elements, B, Nb, Zr or Mo. The $Ni_3Al$ alloy preferably contains sufficient boron for ductility and may include other elements such as Hf, Zr, Ce, Cr and mixtures thereof as needed to tailor the characteristics of the final composite product. For example, a binder such as IC-218 (see Table 2 for composition) should be employed if high hardness is desired. If high toughness is preferred, then IC-50 can be employed. Alloy IC-218 is typical of the alloys claimed in U.S. Pat. No. 4,722,828 and can be employed with or without iron and with or without chromium.

The ceramic material employed in the present invention is a hard ceramic material, and preferably comprises a metal carbide, nitride or oxide, preferably of a refractory metal. Examples of ceramic materials include WC, TiC, $B_4C$, $TiB_2$, TiN, VC, TaC, NbC, $Al_2O_3$, and mixtures thereof. Carbides are preferred. Tungsten carbide is the preferred carbide.

The composite material of the invention is prepared by known methods for consolidating powdered metallic materials. These methods include, for example, hot pressing, sintering, hot isostatic pressing using gaseous pressure, and rapid omnidirectional compaction.

The improvement to be gained from use of the subject invention will become more apparent from the following example.

SPECIFIC EMBODIMENTS OF THE INVENTION

Example 1

Figure 1:
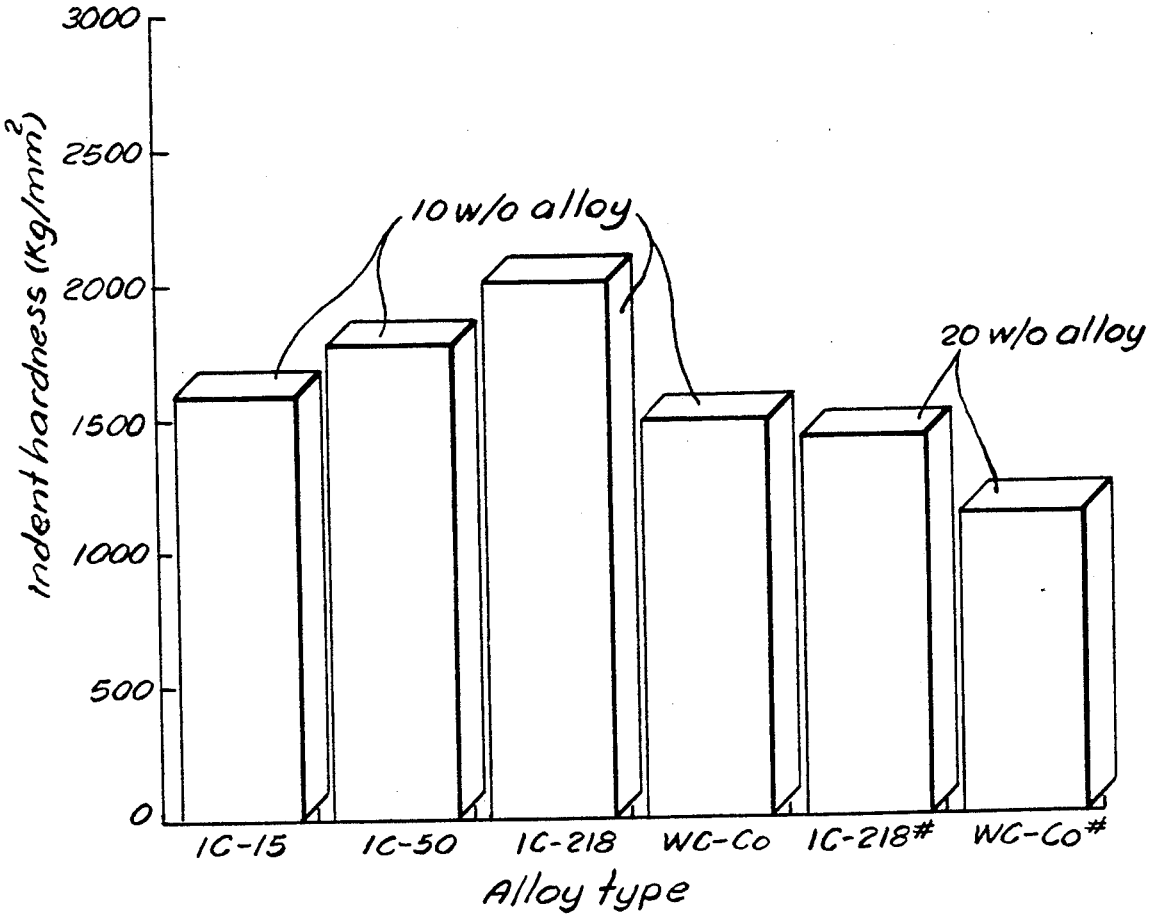
FIG. 1 is a bar graph comparing the hardness of ductile nickel aluminide bonded tungsten carbide in accordance with the invention with conventional cobalt bonded tungsten carbide.

Composites of WC bonded with ductile $Ni_3Al$ alloys are prepared by milling WC powder and $Ni_3Al$ powder in hexane for 2 to 8 hours to achieve a homogeneous mixture. The mix is dried and hot-pressed at 1150° to 1350° C. at 4 ksi for a period of 60 minutes. Composites are prepared using 5 to 20 weight percent alloy selected from compositions specified in Table 3. Fabrication parameters are shown in Table 1. Temperatures of 1300° C. are sufficient to densify composites containing 10 weight percent alloy. However, full density is not achieved at an alloy content of 5 weight percent at 1300° C. Table 4 and FIG. 1 show the indent hardness of the above-described composites. The indent hardness of the subject composites are compared to typical WC/Co composites in Table 2.

Example 2

The procedure of Example 1 is repeated except that 80 g of TiC and 20 g of IC-218 are mixed and then hot pressed for 90 minutes at 1300° C. The density of the resulting part is 5.326 g/cc, or 100 percent of theoretical density. The hardness of the resulting part is 2180 kg/mm$^2$.

Example 3

The procedure of Example 2 is repeated except that 80 g of TiN and 20 g of IC-218 are mixed and then hot pressed for 60 minutes. The density of the resulting part is 5.704 g/cc, or 99.4 percent of theoretical density.

Example 4

The procedure of Example 3 is repeated except that 80 g of $Al_2O_3$ and 20 g of IC-218 are employed. The density of the resulting part is 4.296 g/cc, or 97.7 percent of theoretical density. The hardness of the resulting part is 1555 kg/mm$^2$.

TABLE 1

| | WC/Metal Binder | | | | |
|---|---|---|---|---|---|
| Sample | Alloy Content | Alloy Type | Hot-Press Temp. (C.) | Density (g/cc) | Density (% T.D.)* |
| MMC-1 | 10 | IC-218 | 1350 | 14.69 | 100 |
| MMC-1A | 10 | IC-218 | 1250 | 11.68 | 81.7 |
| MMC-2A | 5 | IC-218 | 1180 | 9.66 | 64.8 |
| MMC-2B | 5 | IC-218 | 1300 | 12.88 | 86.4 |
| MMC-3A | 20 | IC-218 | 1150 | 8.96 | 69.1 |
| MMC-3B | 20 | IC-218 | 1300 | 12.86 | 99.2 |
| MMC-4A | 10 | IC-15 | 1300 | 14.05 | 99.6 |

TABLE 1-continued

| | WC/Metal Binder | | | | |
|---|---|---|---|---|---|
| Sample | Alloy Content | Alloy Type | Hot-Press Temp. (C.) | Density (g/cc) | Density (% T.D.)* |
| MMC-5A | 10 | IC-50 | 1300 | 14.08 | 99.8 |

*T.D. = Theoretical density

TABLE 2

| Alloy | Alloy Content (Wt %) | Indent Hardness (Kg/mm$^2$) |
|---|---|---|
| IC-15 | 10 | 1593 |
| IC-50 | 10 | 1782 |
| IC-218 | 10 | 2008 |
| Co* | 10 | 1500 |
| IC-218 | 20 | 1409 |
| Co* | 20 | 1150 |

*not an embodiment of the present invention.

TABLE 3

| | Nickel Aluminide Composition (Wt. %) | | | | |
|---|---|---|---|---|---|
| | Al | B | Hf | Cr | Ni |
| IC-15 | 12.7 | 0.05 | — | — | Bal. |
| IC-50 | 11.3 | 0.02 | 0.6 | — | Bal. |
| IC-218 | 8.5 | 0.02 | 0.8 | 7.8 | Bal. |

TABLE 4

| | WC/Metal Binder | | |
|---|---|---|---|
| Sample | Vickers Hardness (Kg/mm$^2$) | Rockwell A Hardness ($R_a$) | Indent Toughness (MPa m 0.5) |
| MMC-1 | 2010 | 94 | 8.3 |
| MMC-2B | 1070 | 83 | 9.9 |
| MMC-3B | 1410 | 89 | 11.6 |
| MMC-4A | 1595 | 91 | 10.1–11.5 |
| MMC-5A | 1780 | 92.5 | 10.5–12.4 |

From the above data, it is seen that the composites of the present invention are surprisingly hard materials. For some alloy contents, composites prepared in accordance with this invention are up to about 33 percent harder than typical WC-Co values.

Figure 2:
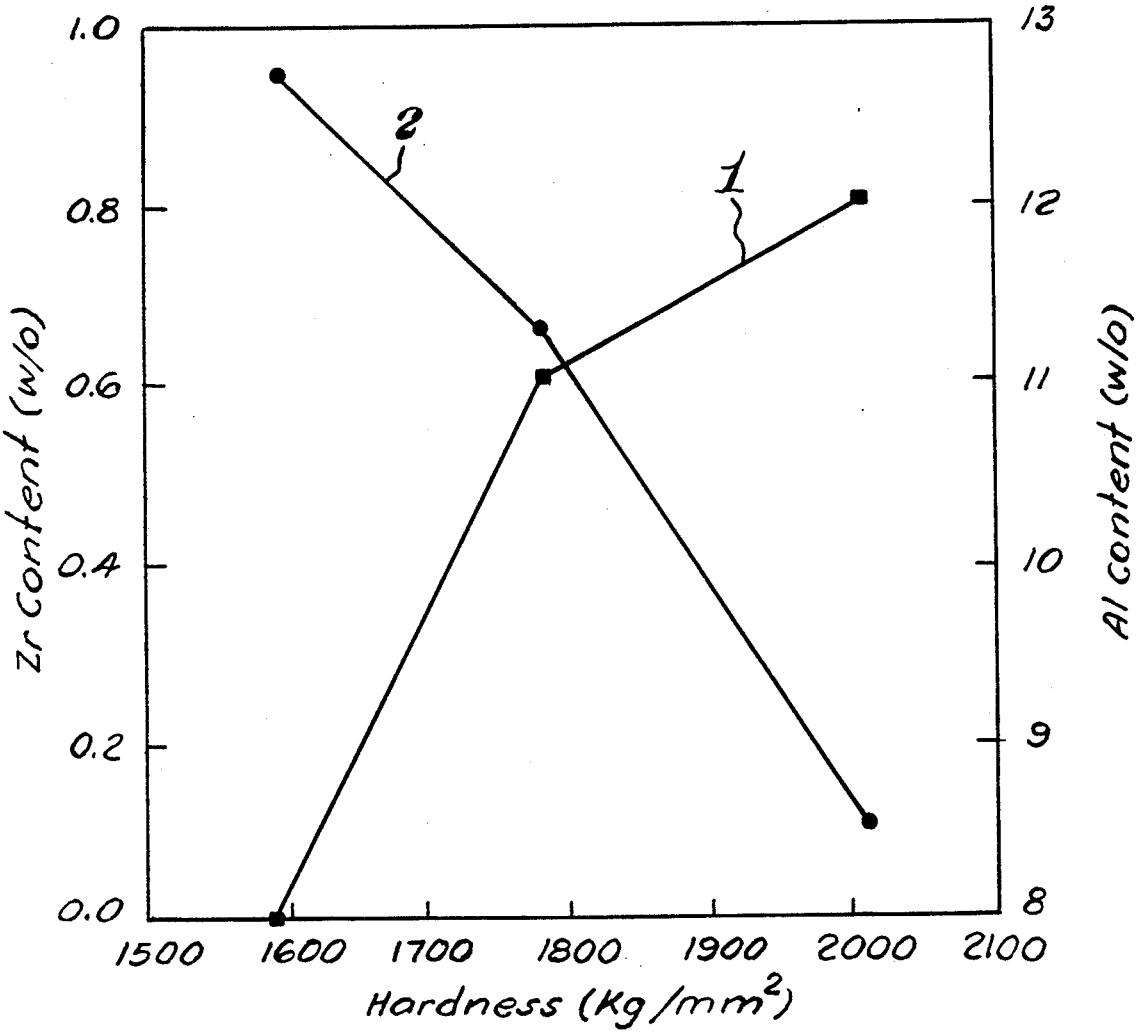
FIG. 2 is a graph showing the hardness of ductile $Ni_3Al$ alloy bonded tungsten carbide as a function of Zr and Al content in the bonding alloy. The hardness of ductile $Ni_3Al$ alloy bonded to tungsten carbide as a function of Zr content is depicted on FIG. 2 by the line labeled 1. The hardness of ductile $Ni_3Al$ alloy bonded to tungsten carbide as a function of Al content is depicted on FIG. 2 by the line labeled 2.

Ductilized nickel aluminide alloys such as are shown in Table 3 have the unique feature of exhibiting increasing strength with increasing temperature up to a temperature of about 700°–800° C. Further, the strength, hardness, and corrosion resistance vary with minor additions of alloying agents such as Hf, Zr, Cr, Ce, etc. as taught, e.g., in the patents incorporated herein by reference. Therefore, by varying the alloying agents, the characteristics of a ceramic-$Ni_3Al$ composite may be varied. FIG. 2 is a graph showing the hardness of WC-$Ni_3Al$ composites (alloy numbers IC-15, IC-50, and IC-218) as a function of Zr and Al content. It is apparent that composite hardness can be increased either by increasing Zr content or decreasing Al content in $Ni_3Al$ alloys. Also, for binders having a density of at least 99 percent of theoretical density, the composites show decreasing hardness and increasing toughness as the alloy content in the composite increases (Tables 1 and 4).

These property determinations indicate that these classes of materials offer significant improvements over current WC/Co materials. The $Ni_3Al$ based composites have higher hardness for comparable alloy contents, which is an important factor in performance for cutting tool and wear applications. In addition, the $Ni_3Al$ based materials retain these properties up to higher temperatures compared to WC/Co materials. Economically, use of $Ni_3Al$ will be less expensive than cobalt. Since cobalt is a strategic material, the use of $Ni_3Al$ enables replacement of a strategic material with more readily available components. Thus the present invention offers performance, strategic, and cost advantages over current materials.

What is claimed is:

1. A cutting tool prepared from a composition comprising a refractory metal carbide and a ductile $Ni_3Al$ alloy.

2. A cutting tool prepared from a composition comprising a ceramic material and a ductile metal alloy selected from the group consisting of alloys of $Ni_3Al$, $TiSi_2$, NiSi, $MoSi_2$, and mixtures thereof.

3. A process for the preparation of a cemented carbide article having a composition comprising a ceramic material and a ductile metal alloy selected from the group consisting of alloys of $Ni_3Al$, $TiSi_2$, NiSi, $MoSi_2$, and mixtures thereof, the process comprising;

(a) blending powders of the ceramic material and the ductile metal alloy to form a mixture; and (b) consolidating the mixture under conditions of temperature and pressure such that a densified cermeted carbide article is produced, the process being conducted in the absence of a metal leaching step.

* * * * *

UNITED STATES PATENT AND TRADEMARK OFFICE

CERTIFICATE OF CORRECTION

PATENT NO. : 5,015,290

DATED : May 14, 1991

INVENTOR(S) : Terry N. Tiegs and Robert R. McDonald

It is certified that error appears in the above-identified patent and that said Letters Patent is hereby corrected as shown below:

Title page, Field [73], the Assignee should read as follows: --The Dow Chemical Company, Midland, Michigan and Martin Marietta Energy Systems, Inc., Oak Ridge, Tennessee --.

Signed and Sealed this

Nineteenth Day of January, 1993

*Attest:*

DOUGLAS B. COMER

*Attesting Officer*

*Acting Commissioner of Patents and Trademarks*